US006577062B2

(12) United States Patent
Itokawa et al.

(10) Patent No.: US 6,577,062 B2
(45) Date of Patent: Jun. 10, 2003

(54) PLASMA DISPLAY PANEL

(75) Inventors: Naoki Itokawa, Akashi (JP); Yasunobu Hashimoto, Akashi (JP); Osamu Toyoda, Akashi (JP); Yoshiho Seo, Akashi (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/051,103

(22) Filed: Jan. 22, 2002

(65) Prior Publication Data

US 2003/0042854 A1 Mar. 6, 2003

(30) Foreign Application Priority Data

Aug. 28, 2001 (JP) ..... 2001-257103

(51) Int. Cl.[7] ..... H01J 17/99

(52) U.S. Cl. ..... 313/582

(58) Field of Search ..... 313/582, 586

*Primary Examiner*—Vip Patel
(74) *Attorney, Agent, or Firm*—Staas & Halsey LLP

(57) ABSTRACT

A plasma display panel for easy fabrication is provided with an improved black stripe structure. The structure eliminates the black stripes on a front substrate, leading to more freedom in material selection without suffering from the known problem of tarnishing of component members. Further, non-discharge spaces are provided in barrier ribs formed on a rear substrate and black material layers functioning as the black stripes are formed in cavities corresponding to the non-discharge spaces. Thus, this structure serves to form the black material layers in a sequential process which is similar to that for forming phosphor layers, thereby allowing the plasma display panel to have excellent contrast without complicating the structure and the fabrication process thereof.

6 Claims, 7 Drawing Sheets

PLASMA DISPLAY PANEL

BACKGROUND OF THE INVENTION

1. Field of the Invention

The present invention relates to improvements of matrix-type color plasma display panels using gas discharge, and more particularly to an improved black stripe structure provided for better contrast in an surface-discharge ac plasma display panel so as to obtain panels of higher quality.

2. Description of the Related Art

Surface-discharge ac plasma display panels are commercially used as flat and large full-color display devices in various fields. In the typical structure of these panels, a discharge gas is filled the space between a front substrate and a rear substrate, and pairs of display electrodes are formed along display lines on the front substrate. With this structure, surface-discharge between the pairs of display electrodes generates ultraviolet ray emission and allows phosphors provided on the rear substrate to emit visual light, thus performing color display. The pairs of display electrodes on the front substrate are typically covered with a dielectric layer formed of low melting point glass. On the rear substrate, address electrodes extend under the phosphors in a direction intersecting with the pairs of display electrodes, and barrier ribs for separating the discharge space are provided between the adjacent address electrodes.

As described above, the usual type plasma display panels currently in practical use is the so-called reflection type in which light emitted from the phosphors on the rear substrate is viewed through the front substrate. To accomplish clear full-color display, the "contrast" is measured as one of the quality evaluation factors display panels, and thus, improvement of the contrast is a major requirement. In conventional plasma display panels, because phosphor layers on the rear substrate, which are visible through the front substrate, and reflection of external light at the surface of the front substrate are the major factors causing deterioration of the contrast, so-called black stripes are provided between the adjacent display lines on the front substrate to overcome this problem.

As disclosed, for example, in Japanese Unexamined Patent Application Publication No. 09-129142, the conventional black stripes are provided on the same surface of the front substrate on which the display electrodes are disposed so as to fill in the spacings between the adjacent display lines (referred to as reverse slits) and are covered, together with the display electrodes, with the dielectric layer. As a result, the display electrodes, the black stripes formed of black pigment, and the dielectric layer mainly composed of lead oxide lie contacting each other or close to each other on the front substrate, wherein each display electrode consists of a transparent electrode typically composed of ITO and a metal bus electrode composed of copper or the like. This structure causes an unexpected chemical reaction to occur in the fabrication process or the baking process of each component, thereby resulting in problems such as discoloration of the black stripes, which are supposed to be black, or tarnishing of the dielectric layer which is supposed to be transparent. Accordingly, countermeasures for solving these problems lead, to a large extent, to less freedom in the design of the layout pattern or material selection for each component.

SUMMARY OF THE INVENTION

Accordingly, it is an object of the present invention to provide a plasma display panel which can be easily fabricated by improving the structure of black stripes, and which has better contrast as much as possible by eliminating reflection factors of external light. Further, it is another object of the present invention to provide a plasma display panel having wider design versatility and more freedom of material selection by providing means for preventing reflection of external light on a rear substrate without complicating the fabrication process thereof.

The main point of the present invention lies in providing the black stripes, which are conventionally provided on a front substrate, between barrier ribs on the rear substrate. The black stripes are not limited to a sequential arrangement between rows or columns of the matrix, but may include an arrangement in which individual stripes are discretely provided corresponding to dots. Hereinafter, the black stripes are referred to as black material layers.

To this end, the present invention is made as will be described further in detail.

A plasma display panel comprises the following elements: a front substrate; a rear substrate opposing the front substrate across a predetermined discharge space; a dielectric layer; a plurality of display electrodes covered with the dielectric layer and extending in a first direction; a plurality of address electrodes extending in a direction intersecting the first direction; a plurality of discharge cells provided at the intersections between the display electrodes and the address electrodes; a plurality of barrier ribs formed in a predetermined pattern for separating the matrix of the discharge cells in at least one of the row direction and the column direction of the matrix, the pattern defining a plurality of non-discharge cavities in the portions of the barrier ribs corresponding to the non-discharge areas between adjacent rows or columns of the discharge cells; a plurality of phosphor layers provided in the discharge cells defined by the pattern of the barrier ribs; and a plurality of black material layers formed in the non-discharge cavities. The dielectric layer and the display electrodes are formed on the front substrate. The address electrodes, the discharge cells, the barrier ribs, the phosphor layers, the non-discharge cavities, and the black material layers are formed on the rear substrate.

The structure of the plasma display panel according to the present invention eliminates the black stripes on the front substrate, leading to more freedom in material selection without suffering from the known problem of tarnishing of the component members of the display panel. Further, the non-discharge spaces are provided in the barrier ribs formed on the rear substrate and the black material layers functioning as the black stripes are formed in the non-discharge cavities corresponding to the non-discharge spaces. Thus, this structure serves to form the black material layers in a subsequent process which is similar to that of forming the phosphor layers, thereby allowing the plasma display panel to have excellent contrast without complicating the structure and the fabrication process thereof.

DESCRIPTION OF THE PREFERRED EMBODIMENTS

Referring to the accompanying drawings, preferred embodiments of the present invention will now be described in detail.

First Embodiment

Figure 1:
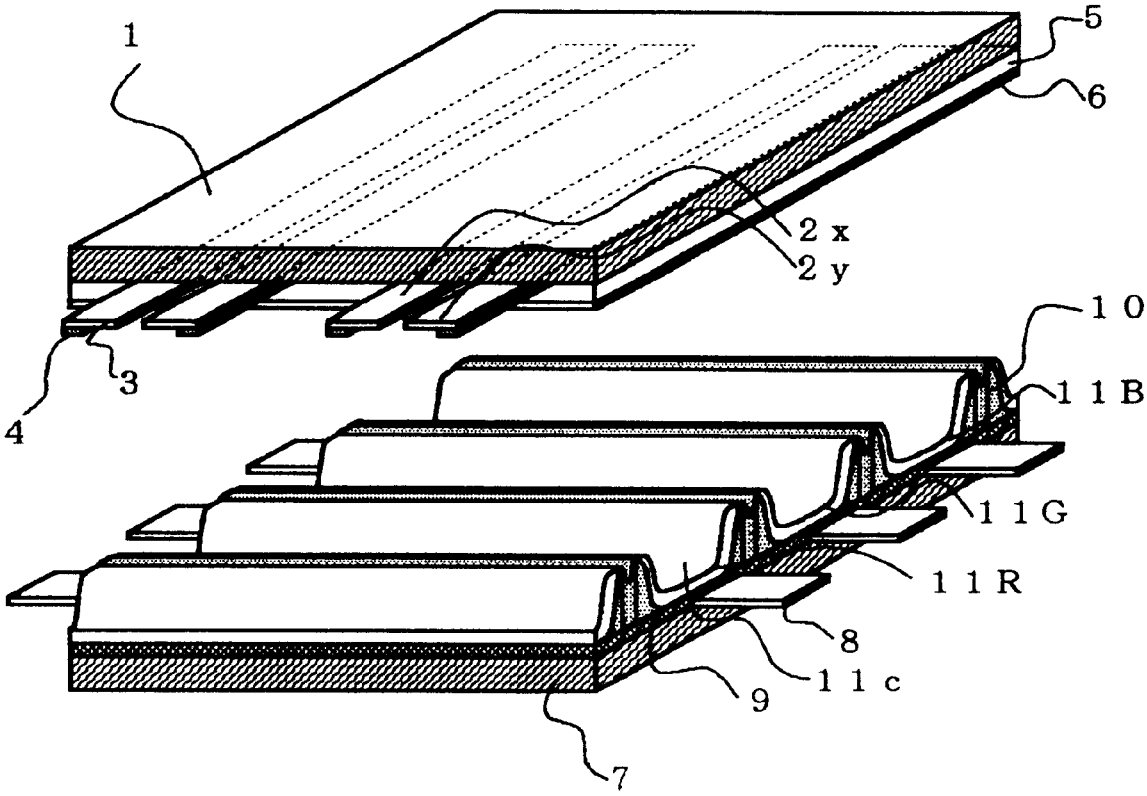
FIGS. 1 and 2 are, respectively, an exploded perspective view and a sectional view of a main part of a plasma display panel according to a first embodiment of the present invention.
Figure 2:
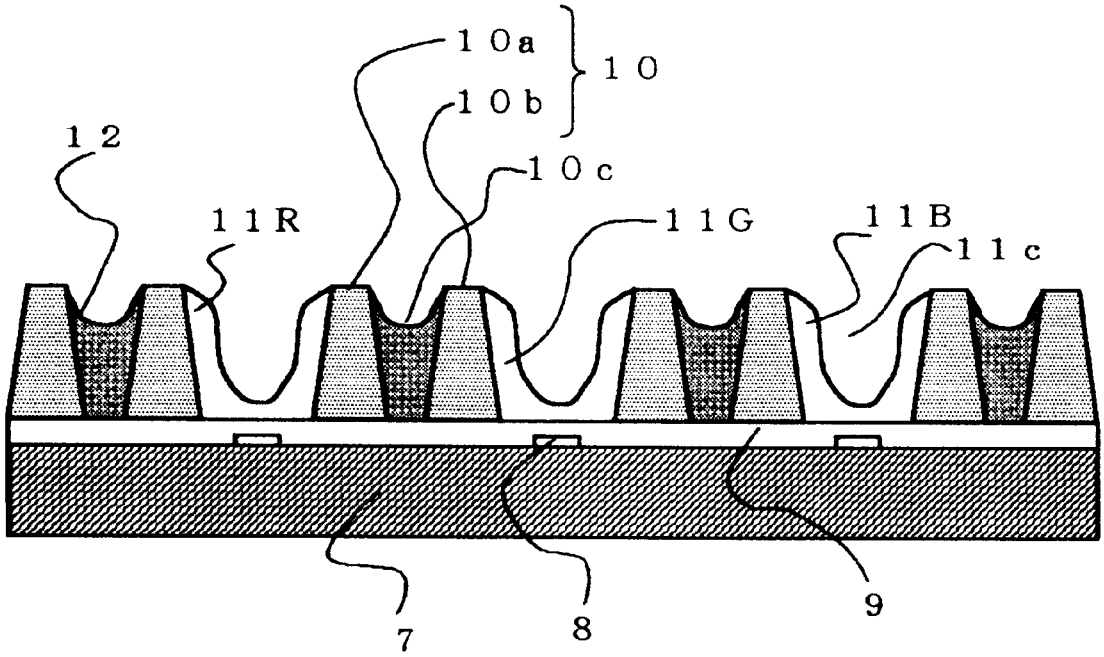

FIGS. 1 and 2 are, respectively, an exploded perspective view and a sectional view of a main part of a plasma display panel according to a first embodiment of the present invention. These drawings illustrate an exemplary application of the present invention to a typical three-electrode surface-discharge ac plasma display panel having stripe barrier ribs. In the display panel, stripe barrier ribs 10 have a split pattern, and black material layers 12 are formed in non-discharge cavities 10*c* formed in channels between adjacent split portions 10*a* and 10*b* of the barrier ribs 10. Three kinds of phosphors 11R, 11G, and 11B are formed in discharge cavities 11*c* between the barrier ribs 10. The non-discharge cavities 10*c* correspond to the non-display areas and the discharge cavities 11*c* correspond to the display areas.

Further, a front substrate 1 formed of a transparent glass plate has pairs of display electrodes 2 on the inner surface thereof, each pair consisting of display electrodes 2*x* and 2*y* extending along virtual display lines, and is covered with a dielectric layer 5 and a protecting layer 6 composed of MgO in that order. Each display electrode consists of a transparent electrode 3 composed of ITO and a metal bus electrode 4. The transparent electrode 3 is not limited to having a straight pattern as shown in the drawing, but may have a T-shaped pattern or an I-shaped pattern at each discharge cell, or a ladder pattern.

A rear substrate 7 formed of the same type of glass plate as that of the front substrate has a plurality of address electrodes 8 extending in a direction intersecting the display electrodes 2*x* and 2*y* and is covered by a rear dielectric layer 9 formed of low-melting point glass. On the rear dielectric layer 9, the stripe barrier ribs 10 are formed between the corresponding adjacent address electrodes. Red, green, and blue phosphors 11R, 11G, and 11B for the three primary colors are applied in channels between the adjacent barrier ribs such that each of the phosphors covers with not only the rear dielectric layer but also the sidewalls of corresponding barrier ribs, respectively.

The structure of the plasma display panel described so far is the same as that of known full-color surface-discharge plasma display panels. The plasma display panel according to the present invention has a remarkable feature in which each of the stripe barrier ribs 10 is split into two split portions 10*a* and 10*b* and each of the black material layers 12 is formed in the corresponding non-discharge cavities 10*c* provided in a channel between the adjacent split portions 10*a* and 10*b*. The structure of the split portions, i.e., the structure of the cavities is formed as a part of a barrier rib pattern in a process of forming the barrier ribs by a known method such as screen printing, sand blasting, embedding, or embossing. The same paste material as that commercially used for conventional black stripes can be used for the black material layers 12, wherein the paste material is composed such that a dark pigment such as an oxide of Fe, Cr, Co, or Ni is mixed with an organic binder and an organic solvent. Immediately after the paste phosphors 11R, 11G, and 11B are printed in the corresponding spaces between the adjacent barrier ribs, the black material layers 12 are formed by printing the dark pigment paste in the non-discharge cavities 10*c*, and by cofiring the black material layers 12 and the phosphors in that order without requiring a substantially additional process.

The panel is completed by combining the front substrate 1 and the rear substrate 7 having the above structures, sealing the periphery of these substrates, and being filled a discharge gas mixture in the inner space therebetween. According to the plasma display panel of the first embodiment, black stripes or the like are not provided on the front substrate; rather, the black material layers 12 are formed in the non-discharge cavities 10*c* provided in the stripe barrier ribs 10 on the rear substrate so that the overall reflection of external light in the panel is reduced, thereby improving the contrast of the panel.

Second Embodiment

Figure 3:
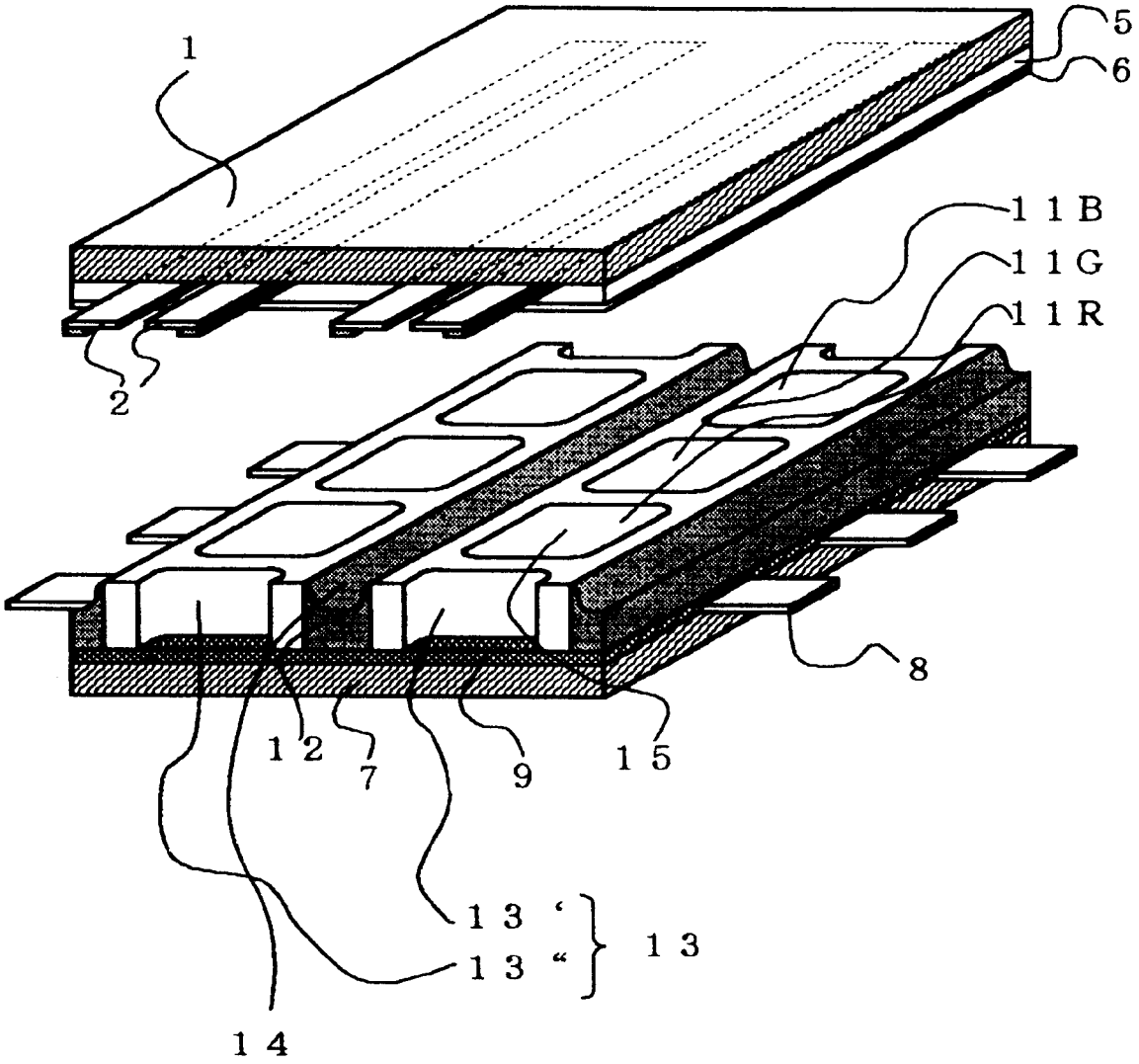
FIG. 3 is an exploded perspective view of the main part of a plasma display panel according to a second embodiment of the present invention.

FIG. 3 is an exploded perspective view according to a second embodiment of the present invention, illustrating an exemplary application of a plasma display panel having a barrier rib structure of a so-called waffle or lattice rib structure. The front substrate 1 has the pairs of display electrodes 2, the dielectric layer 5, and the protecting layer 6 thereon in that order in the same manner as that shown in FIG. 1 according to the first embodiment. Lattice barrier ribs 13 are provided on the dielectric layer 9 covering the address electrodes 8 on the rear substrate 7, each barrier rib 13 defining an individual cavity 15 corresponding to each discharge cell. The cavities 15 lie at the corresponding intersections of the pairs of display electrodes 2 with the address electrodes 8, serve as discharge cavities, and constitute discharge cells. The red, green, and blue phosphors 11R, 11G, and 11B are cyclically applied on the inner walls of the cavities 15 and on the dielectric layer 9 in a longitudinal direction of the pairs of display electrodes 2.

When viewed as a whole, the barrier ribs 13 are formed so that each of the discharge cells lies in a lattice pattern. When viewed in detail, however, each of the barrier ribs 13 consists of barrier rib strips 13' and 13" which are split up in a ladder pattern at each display line, and non-discharge cavities 14 are provided between the adjacent barrier rib strips. According to the second embodiment, the black material layers 12 are formed in the non-discharge cavities 14 extending along the spaces between the adjacent display lines so as to function as conventional black stripes. The black material layers 12 are formed in the same manner as that of the first embodiment such that paste including black pigment is applied on the non-discharging cavities 14 by screen printing, by a dispensing method, or by photolithography, and is baked together with the phosphors for the three colors which are applied on the discharge cavities 15 before or after the above process.

Other Embodiments

Figure 4:
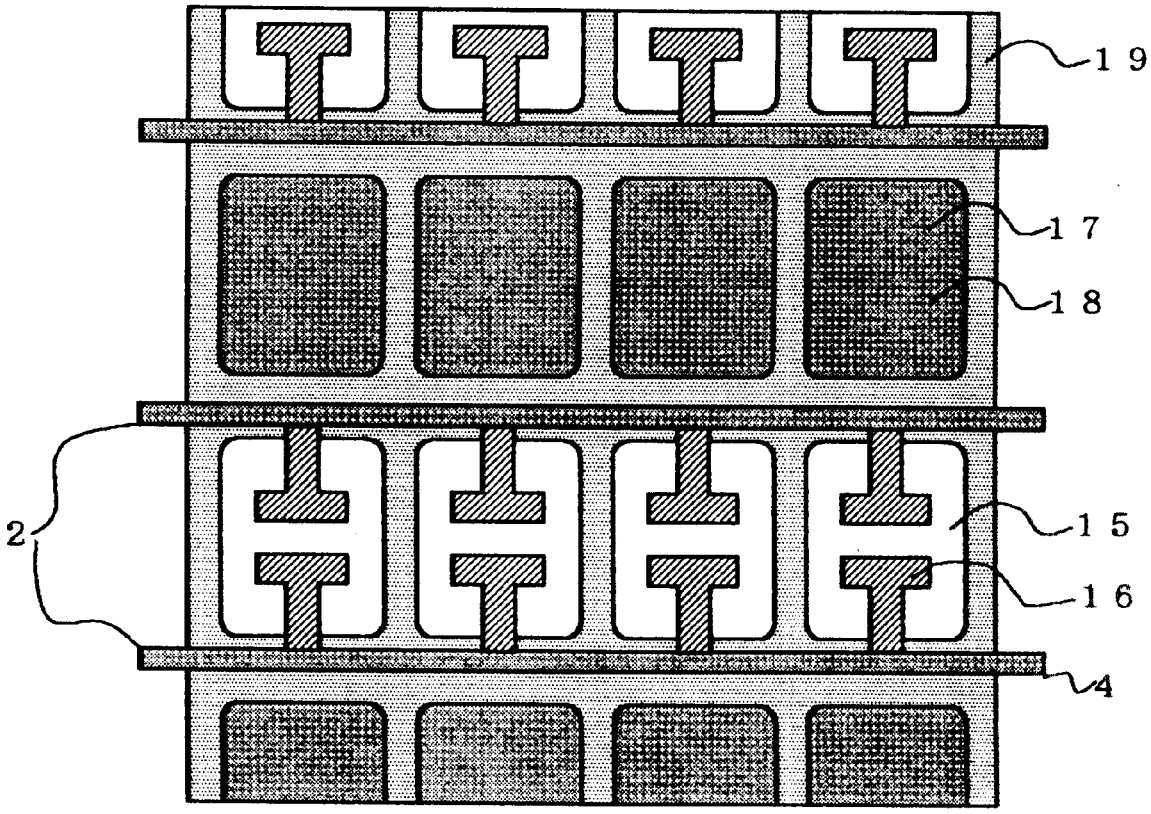
FIG. 4 is a plan view of the main part of a plasma display panel according to another embodiment of the present invention.
Figure 5:
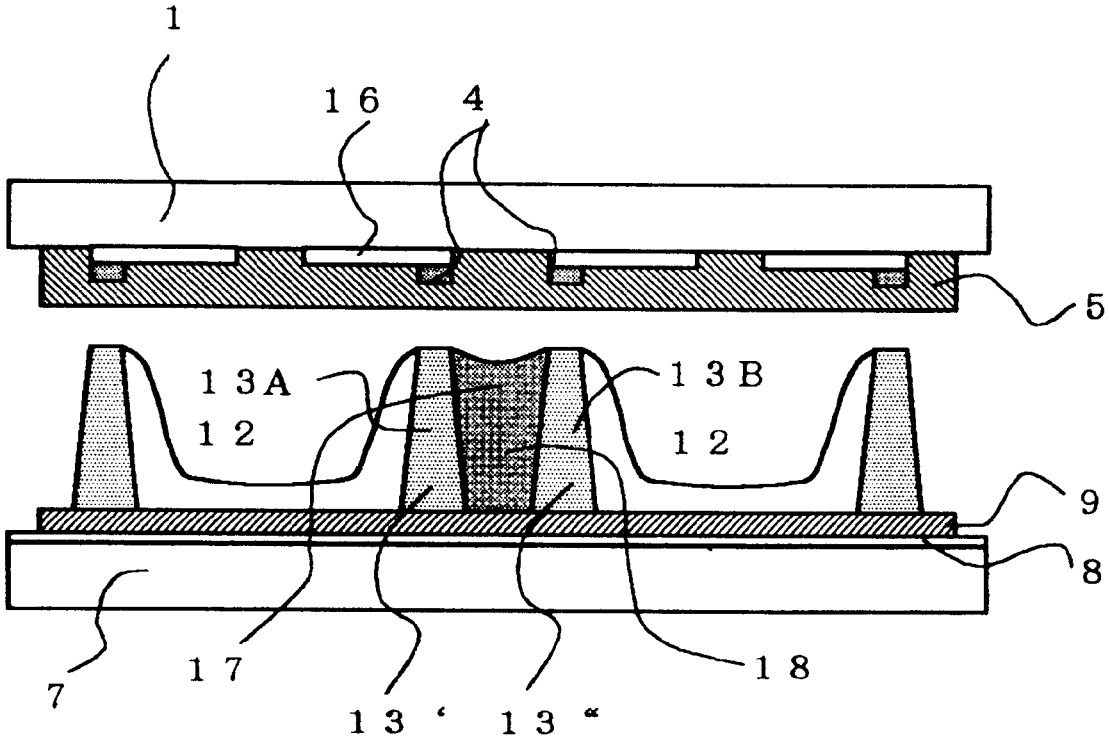
FIG. 5 is a sectional view of the main part of a plasma display panel according to still another embodiment of the present invention.

Referring now to FIGS. 4 and 5, a plasma display panel according to modifications of the above embodiments will be described.

FIG. 4 is a plan view of the main part of a plasma display panel according to a modification of the second embodiment.

In this case, each of the pairs of display electrodes 2 consists of the metal bus electrode 4 extending along the longitudinal direction of the display lines and T-shaped transparent electrodes 16, each transparent electrode branching from the metal bus electrode 4 into the corresponding discharge cell. The tops of the two T-shaped transparent electrodes 16 oppose each other at the corresponding portion of each of the discharge cavities 15. Lattice barrier ribs 19 have a pattern defining the discharge cavities 15 and a plurality of non-discharge cavities 17 in the spaces between the adjacent display lines. Black material layers 18 are formed in the non-discharge cavities 17 in the same manner as described above.

FIG. 5 is a sectional view of the main part of a plasma display panel according to another modification of the first and the second embodiments.

The plasma display panel according to this modification basically has the same structure as that of the first and the second embodiments. The difference in the structure lies in that the tops of sidewalls 13A and 13B of the split barrier rib strips 13' and 13" underlie the corresponding metal bus electrodes 4 and also the non-discharge cavities 17 between the adjacent barrier rib strips are filled substantially fully with the black material layers 18 so as to prevent the occurrence of an unnecessary discharge thereat. According to the modification shown in FIG. 5, the dark metal bus electrodes 4 having, for example, a three-layer structure of Cr—Cu—Cr mask the tops of the barrier ribs corresponding to the non-display areas (referred to as reverse slits) between the adjacent display lines, thereby making the entire spaces between the adjacent display lines dark.

Figure 6:
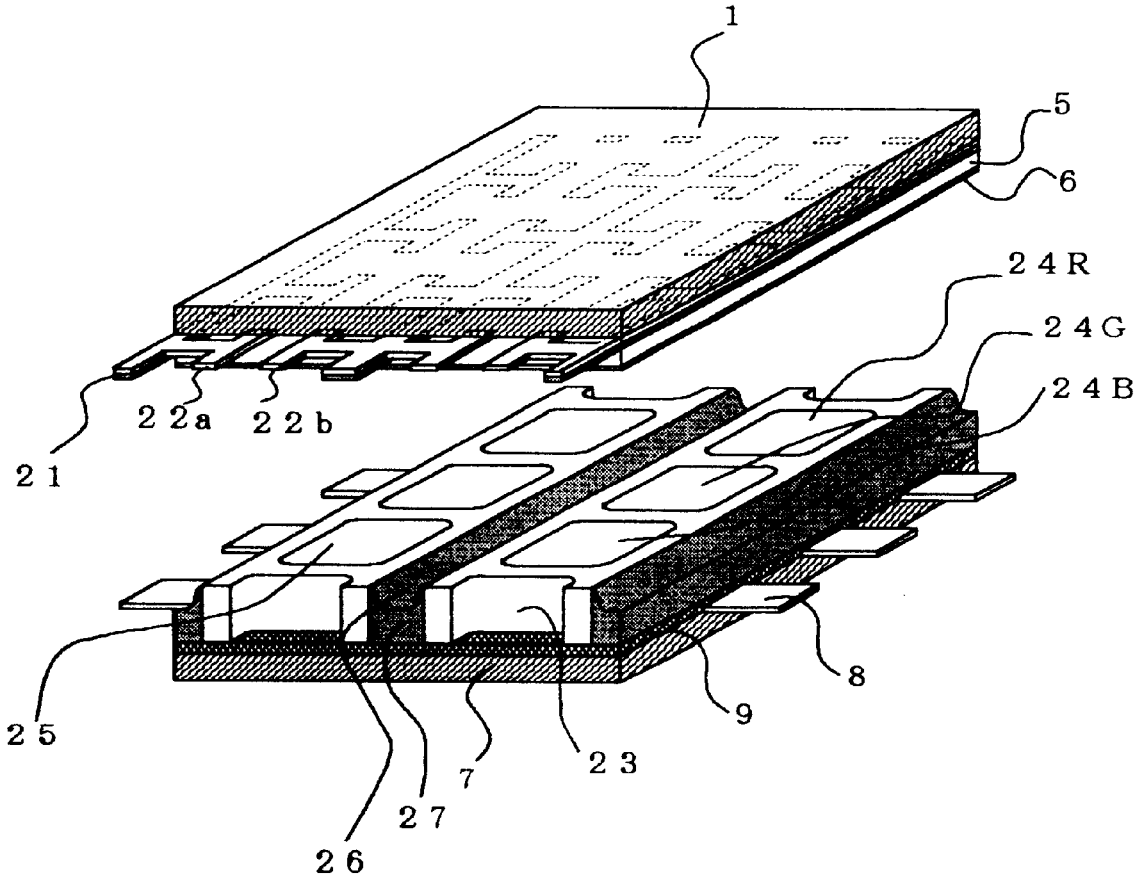
FIG. 6 is an exploded perspective view of the main part of an ALIS plasma display panel as an exemplary application of the present invention.
Figure 7:
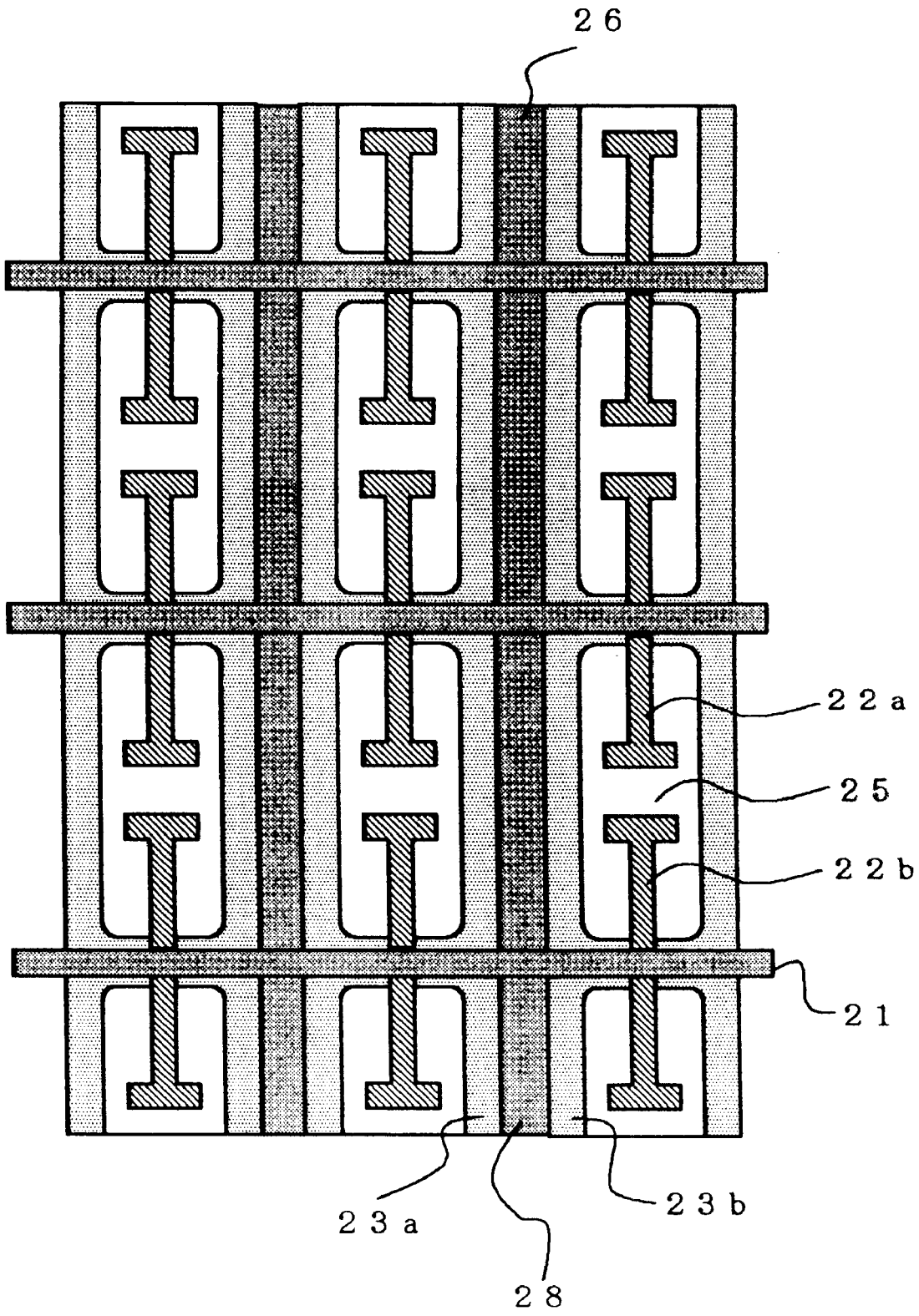
FIG. 7 is a plan view of the main part of an ALIS type plasma display panel as another exemplary application of the present invention.

Referring now to FIGS. 6 and 7, exemplary plasma display panels of the present invention applied to an ALIS type plasma display panel will be described.

FIG. 6 is an exploded perspective view of the main part of the so-called ALIS type plasma display panel, in which it is possible to perform full pitch display by an interlace driving system, as an exemplary application of the present invention. The front substrate 1 has, on the inner surface thereof, a plurality of metal bus electrodes 21 evenly spaced along the direction of the display lines and T-shaped transparent electrodes 22*a* and 22*b* branching in the opposite directions at a predetermined interval. The rear substrate 7 has lattice barrier ribs 23, each defining a discharge cell at the portion where each of the T-shaped transparent electrodes 22*a* and the corresponding T-shaped transparent electrodes 22*b* closely oppose each other. The lattice barrier ribs 23 have discharge cavities 25, each painted with one of three colored phosphors 24R, 24G, 24B corresponding to each discharge cell, and are divided in every display line in a similar fashion to the modification shown in FIG. 4. Black material layers 27 are formed in non-discharge cavities 26 formed in the spaces between the adjacent barrier rib strips, each space facing each of the metal bus electrodes 21, in the same manner as the above modification. The panel according to this exemplary application is not limited to an interlace driving system but may operate with a progressive driving system, and also is not limited to T-shaped transparent electrodes.

FIG. 7 is a plan view of the main part of an ALIS type plasma display panel as another exemplary application of the present invention.

Barrier rib strips 23*a* and 23*b* are divided in a direction orthogonal to the metal bus electrodes 21 serving as the display electrodes, i.e., orthogonal to the display lines, and black material layers 28 are formed in the non-discharge cavities 26 between the adjacent barrier rib strips 23*a* and 23*b*. As long as this plan view is observed, no special features in providing the non-discharge cavities in the barrier rib structure are apparent, and the structure does not look different from that in which the tops of the barrier ribs are black. However, the structure of the present invention is of great use since the discharge cavities and the non-discharge cavities are formed at the same time, and also, immediately after the phosphors are applied to the discharge cavities of the discharge cells, the black material paste can be applied in the same application process.

As described above in detail, the plasma display panel according to the present invention has a structure in which the rear substrate has the non-discharge cavities thereon in a linear pattern or in a dot pattern between the adjacent barrier ribs, an also in the corresponding spaces between the adjacent display rows or the adjacent display columns. With this configuration, discoloring and tarnishing can be prevented, which occur when the black material layers serving as black stripes are formed on the front substrate, and a black stripe function can be provided on the rear substrate without requiring a substantially additional process, thereby allowing a plasma display panel to have high contrast and high quality, and to be less expensive.

What is claimed is:

1. A plasma display panel comprising:

a front substrate;

a rear substrate opposing the front substrate across a predetermined discharge space;

a plurality of display electrodes formed on the front substrate, covered with a dielectric layer, and extending in a first direction;

a plurality of address electrodes formed on the rear substrate and extending in a second direction intersecting the first direction;

a plurality of discharge cells provided at the intersections between the display electrodes and the address electrodes;

a plurality of barrier ribs superposed on the rear substrate and formed in a predetermined pattern for separating the matrix of the discharge cells in at least one of the row direction and the column direction of the matrix, the pattern defining a plurality of non-discharge cavities in the portions of the barrier ribs corresponding to the non-discharge areas between adjacent rows or columns of the discharge cells;

a plurality of phosphor layers provided in the discharge cells defined by the pattern of the barrier ribs; and a plurality of black material layers formed in the non-discharge cavities.

2. The plasma display panel according to claim 1, wherein the barrier ribs for separating the matrix of the discharge cells have a pattern separating the discharge space to define the discharge cells between the adjacent address electrodes in parallel with the address electrodes, the plurality of channel non-discharge cavities are formed in the portions of the barrier ribs corresponding to the non-display areas between the adjacent address electrodes, and the black material layers are formed in the channel non-discharge cavities.

3. The plasma display panel according to claim 1, wherein the barrier ribs for separating the discharge cell matrix have a pattern defining the individual discharge cells provided at the intersections between the display electrodes and the address electrodes, the plurality of channel non-discharge cavities are formed in the portions of the barrier ribs corresponding to the non-display areas between the adjacent display electrodes, and the black material layers are formed in the non-discharge cavities.

4. A plasma display panel comprising:

a front substrate;

a rear substrate opposing the front substrate across a predetermined discharge space;

a plurality of evenly spaced metal bus electrodes formed on the front substrate and covered with a dielectric layer and extending in a first direction;

pairs of transparent electrodes branching from the corresponding metal bus electrode at both sides thereof;

a plurality of address electrodes formed on the rear substrate and extending in a second direction intersecting the first direction;

a plurality of discharge cells provided at the intersections between the address electrodes and the transparent electrodes;

a plurality of barrier ribs superposed on the rear substrate and formed in a predetermined pattern for separating the matrix of the discharge cells in the row direction and the column direction of the matrix, the pattern of the barrier ribs defining a plurality of channel non-discharge cavities in the corresponding spaces of the barrier ribs opposing at least the metal bus electrodes;

a plurality of phosphor layers provided in the discharge cells defined by the barrier rib pattern; and a plurality of black material layers formed in the non-discharge cavities.

5. The plasma display panel according to claim 4, wherein the pairs of transparent electrodes are arranged to branch at a predetermined spacing, each having a T-shape.

6. The plasma display panel according to claim 4, wherein the non-discharge cavities of the barrier ribs are formed sequentially in the row direction.

* * * * *